US007193597B2

(12) United States Patent
Sunohara

(10) Patent No.: US 7,193,597 B2
(45) Date of Patent: Mar. 20, 2007

(54) SEMICONDUCTOR INTEGRATED CIRCUIT AND LIQUID CRYSTAL DISPLAY DEVICE

(75) Inventor: Makoto Sunohara, Tokyo (JP)

(73) Assignee: NEC Corporation, Tokyo (JP)

( * ) Notice: Subject to any disclaimer, the term of this patent is extended or adjusted under 35 U.S.C. 154(b) by 427 days.

(21) Appl. No.: 10/201,969

(22) Filed: Jul. 25, 2002

(65) Prior Publication Data

US 2003/0038771 A1 Feb. 27, 2003

(30) Foreign Application Priority Data

Aug. 21, 2001 (JP) ..... 2001-250448

(51) Int. Cl.
*G09G 3/36* (2006.01)

(52) U.S. Cl. ..... 345/98; 345/100

(58) Field of Classification Search ..... 345/87–100, 345/204

See application file for complete search history.

(56) References Cited

U.S. PATENT DOCUMENTS 6,335,718 B1 * 1/2002 Hong et al. ..... 345/98
6,940,496 B1 * 9/2005 Kim ..... 345/204

FOREIGN PATENT DOCUMENTS

JP 7-212692 A 8/1995
JP 11-194748 A 7/1999
JP 2001-53598 A 2/2001

* cited by examiner

*Primary Examiner*—Regina Liang
(74) *Attorney, Agent, or Firm*—Sughrue Mion, PLLC

(57) ABSTRACT

A CMADS circuit is characterized in that one transmitter is able to drive a plurality of receivers at a high rate to make each of the receivers have a low amplitude. A signal line driving integrated circuit has input terminals formed along one side (for example, left side) of the integrated circuit for receiving each signal via each of CMADS bus lines and output terminals formed along an opposing side (right side) opposite the one side. The input and output terminals are disposed such that a distance from each of the input terminals to a side (lower side) of the integrated circuit along which the signal voltage output terminals are disposed becomes equal to that from each of the output terminals disposed to individually correspond to the input terminals to the lower side. Accordingly, a CMADS bus is formed penetrating the inside of the signal line driving integrated circuit. In a case where a CMADS bus couples a plurality of signal line driving integrated circuits in series, the CMADS bus signal lines constructed as described above can travel throughout a series of the signal line driving ICs without jackknifing at around connection portions between the adjacent integrated circuits, thereby substantially eliminating an entire part of a wiring area required for the conventional LCD device and realizing a small-sized LCD device.

27 Claims, 10 Drawing Sheets

SEMICONDUCTOR INTEGRATED CIRCUIT AND LIQUID CRYSTAL DISPLAY DEVICE

BACKGROUND OF THE INVENTION

1. Field of the Invention

The present invention relates to a semiconductor integrated circuit and a liquid crystal display device, and more particularly to a semiconductor integrated circuit for driving a source electrode of a TFT LCD panel and a liquid crystal display device comprised of a plurality of the semiconductor integrated circuits and the liquid crystal display panel.

2. Description of Related Art

FIG. 1 is a block diagram illustrating the configuration of a conventional liquid crystal display device (hereinafter, referred to as LCD device). In a LCD device 61, image data constituting an image signal and representing a degree of brightness of images at equal intervals on a logarithmic axis is employed as an input. A D.C. voltage varying in accordance with image data is generated based on a reference voltage within a LCD device and is supplied to a Liquid Crystal Display panel (LCD panel) 62 to display images. In this case, in the LCD panel 62, luminance is determined by a degree to which a backlight from a backside of the LCD panel is allowed to transmit through the LCD panel. In a generally used normally white LCD panel, Voltage-Transmittance (V-T) characteristics are specified such that transmittance becomes smaller in proportion to increase in input voltage. Accordingly, gamma correction is made by using the reference gray scale voltages Vγ and image data input according to the V-T characteristics of LCD panel to generate desired D. C. voltages, and then, the D. C. voltages are supplied to the LCD panel 62.

Data transmission from a display control circuit 63 to a signal line driving IC 65 is performed as follows. That is, image data corresponding to red (R), green (G), blue (B) and synchronizing data are inputted to the display control circuit 63, and the display control circuit 63 outputs image data DAT and signal line control signals CON1, CON2. Those signals are inputted to input terminals of individual signal line driving integrated circuits (hereinafter, referred to as signal line driving ICs) 65-1 to 65-m via metal lines formed on a board of a LCD device 1. That is, the input terminals of a plurality of signal line driving ICs 65 are connected to one output terminal of the display control circuit 63.

Configuration and operation of a conventional LCD device shown in FIG. 1 will be explained below. A LCD device 61 comprises a LCD panel 62, a display control circuit 63, a scanning line driving circuit 64 and m pieces of signal line driving ICs 65-1 to 65-m. The number of m pieces is determined by a ratio of the number of signal line inputs of the LCD panel 62 to the number of signal voltage outputs from the signal line driving ICs 65.

In the LCD panel 62, metal lines constituting a plurality of scanning lines are arranged as a row line in a longitudinal direction and metal lines constituting a plurality of signal lines are arranged as a column line in a lateral direction on a display plane, respectively. Pixel electrodes are disposed at all cross points between the scanning lines as a row line and the signal lines as a column line, and a thin film transistor (TFT) is disposed between a pixel electrode and a signal line corresponding to the pixel electrode, and further, a gate electrode of a TFT is connected to a scanning line corresponding to the TFT. Pixel electrodes corresponding to three primary colors, i.e., red (R), green (G), blue (B), are disposed in a horizontal direction to constitute a pixel and a first specific number of the pixels constructed as described above are disposed along the scanning line, and further, a second specific number of the pixel electrodes representing the same color are connected to each of the signal lines in a vertical direction, thereby constituting a pixel plane.

The display control circuit 63 generates image data DAT by rearranging, responsive to synchronizing data, the image data, which corresponds to red (R), green (G), blue (B) and consists of serial data, in accordance with arrangement of the pixels of the LCD panel with respect to individual scanning lines. In addition, the display control circuit 63 outputs the image data DAT to the signal line driving ICs 65-1 to 65-m while outputting, responsive to the synchronizing data, signal line control signals CON1, CON2 to the signal line driving ICs 65-1 to 65-m and scanning line control signal CON3 to a scanning line driving circuit 64, respectively. The signal line control signal CON1 actually consists of several signals which change at a relatively low rate such as a sift direction control signal R/L and latch signal STB. The signal line control signal CON2 actually consists of several signals which change at a relatively high rate such as a clock signal CLK and polarity inversion signal POL.

The scanning line driving circuit 64 outputs scanning signals to individual scanning lines every field period based on the scanning control signal CON3. The signal line driving IC 65 generates signals to which gamma correction is performed at every scanning period according to the V-T characteristics of LCD panel 2 by using the image data DAT and reference gray scale voltages Vγ supplied from the display control circuit 63 based on the signal line control signals CON1, CON2, and then, provides the signal to each signal line.

General operation of the LCD device 61 will be explained below. Image data is outputted from an image-drawing device such as a personal computer with respect to each color, i.e., red (R), green (G), blue (B), for example, in a serial form. The image data corresponding to each color is data consisting of bits corresponding to the number of gray scales of an image to be displayed, for example, is digital data consisting of six bits corresponding to 64 gray scales. In addition, the image-drawing device outputs vertical synchronizing signals as synchronizing data with respect to a display period of each field and horizontal synchronizing signals as synchronizing data with respect to a scanning period corresponding to each row line.

In the LCD device 61, the display control circuit 63 rearranges, responsive to the horizontal and vertical synchronizing data, the inputted image data corresponding to R, G, B with respect to individual scanning lines in such a manner that the order of R, G, B is repeated along a scanning line and then, outputs the image data rearranged in accordance with arrangement of pixels of the LCD panel 62 to the signal line driving ICs 65-1 to 65-m. Furthermore, the display control circuit 63 outputs the scanning line control signal CON3 to the scanning line driving circuit 64 and outputs the signal line control signals CON1, CON2 to the signal line driving ICs 65-1 to 65-*m*.

The scanning line driving circuit 64 sequentially outputs scanning signals corresponding to one field to the individual scanning lines based on the scanning line control signal CON3 for every vertical scanning period. Receiving the scanning signal, each TFT whose gate electrode is connected to the scanning line turns on and an associated signal voltage is supplied from the signal line via the TFT to each pixel connected to the TFT being in an on-state.

Moreover, the signal line driving ICs 65-1 to 65-m receive the image data DAT and reference gray scale voltages Vγ corresponding to the individual colors, i.e., R, G, B, from the display control circuit 63 and perform gamma correction according to the V-T characteristics of the LCD panel 2 corresponding to individual colors to thereby obtain specific gamma value of the LCD panel and generate D. C. signal voltage outputs SO, and then, provide the signal voltage outputs to the associated signal lines of the LCD panel 62.

FIG. 2 illustrates an internal schematic diagram of the signal line driving IC 65. A signal line driving circuit chip 71 includes an internal circuit 14 comprised of a shift register, a data register, a latch circuit, a level shifter, a D/A converter (Digital-to-Analog converter) and a voltage follower output circuit. The signal line driving circuit chip 71 is housed within, for example, a TCP (Tape Carrier Package) and pads 22 of the signal line driving circuit chip 71 and terminals 23 of the package corresponding to the pads are connected to each other. In general, the number of the signal voltage outputs SO supplied from the signal line driving IC 65 to the LCD panel is very large and reaches about a few hundred, producing the following phenomenon. That is, the signal line driving circuit chip 71 is constructed such that one side of the chip 71 along which pads for outputting a signal voltage are disposed becomes far longer than another side thereof perpendicular to the one side when viewing the chip from a position vertical thereto. Terminals of the signal line driving IC 65 for outputting a signal voltage also are disposed in the IC 65 on a side thereof on which the pads for outputting a signal voltage are disposed. Since the number of inputs for receiving the image data DAT is relatively large, input pads of the signal line driving circuit chip 71 are disposed along a side thereof opposite the side thereof along which the pads for outputting a signal voltage are disposed and input terminals of the signal line driving IC 65 also are disposed so as to face the input pads of the chip 71. That is, as shown in FIG. 2, when viewing the IC from a position vertical thereto, generally, the input terminals are disposed, for example, on an upper side of the signal line driving IC 65 and the terminals for signal voltage output are disposed on a lower side thereof opposite the upper side.

In recent years, demand for development of a monitor screen capable of displaying a high resolution image and used for a medical industry or the like has been growing. For example, if images obtained by photographing the inside of human body using X ray were displayed on a high-resolution screen capable of presenting images nearly equal to those observed using a photograph, it becomes possible to observe delicate situation within a body from outside. To realize such high-resolution images on a display of a LCD device, the screen of the device has to be made to have a high density. Furthermore, in order to realize such a high density screen, pixels of the device has to be made fine and in a case where the size of a screen is the same as that of the conventional device, the LCD panel of the device houses a larger number of pixels therein. Since an amount of data increases in proportion to the number of pixels, when transmitting a large amount of image data, the data has to be transmitted at a higher rate. However, when producing high rate clock signals to transmit data at a higher rate, EMI (Electromagnetic Interference) occurs and the noise due to the EMI is imposed on the image data, adversely affecting quality of images to be displayed.

To solve the problems due to the EMI, Japanese Patent Application Laid-open No. 11-194748 as one of conventional techniques discloses the following technique. That is, in a case where the same amount of data is transmitted, clock frequency can be lowered by increasing the number of data buses and further, transmitting data in parallel. However, in the conventional technique disclosed in the above-described publication, the width of bus is required to be increased in proportion to increase in an amount of data, which increase is caused by higher resolution images, and therefore, a wiring area within the LCD device 61 increases, preventing the LCD device from reducing its volume. Since the LCD device is required to reduce its volume such that an outer frame of the LCD device 61 substantially becomes equal to that of the LCD panel 62, as well as to respond to the demand for higher resolution images, such technique requiring increase in a wiring area within the device cannot solve both problems described above.

A technique for providing a high rate interface while suppressing occurrence of EMI makes it possible to transmit data at a high rate from the display control circuit 63 to a plurality of the signal line driving ICs 65 without increase in the number of wiring connections. However, according to an ECL (Emitter Coupled Logic) interface, LVDS (Low Voltage Differential Signaling) interface or the like known as a conventional technique for providing a high rate interface while realizing low EMI, it is difficult to directly supply a signal from one transmitter to a plurality of receivers or it is required to most suitably and individually design the one transmitter depending on the number of the receivers and therefore, the conventional technique for providing a high rate interface has not easily been employed. To address such problems, Japanese Patent Application Laid-open No. 2001-53598 issued by the applicant of the present invention discloses a technique suitably applied for transmitting data at a high rate from one transmitter to a plurality of receivers. The applicant named this transmission method "CMADS (Current Mode Advanced Differential Signaling)" and proposed a LCD device employing this technique for transmitting image data and the like. In a CMADS circuit, since data transmission between the transmitter and receiver is performed by using a pair of differential signals each having an amplitude of about 100 to 200 mV, it becomes possible to transmit data while reducing the transmission of EMI noise to an extent equal to or greater than that could be achieved by using an ECL (Emitter Coupled Logic) interface, LVDS (Low Voltage Differential Signaling) interface or the like. Hereinafter, a transmission part of the CMADS circuit is referred to as a CMADS transmitter and a reception part thereof is referred to as a CMADS receiver, and a transmission line between the CMADS transmitter and CMADS receiver is referred to as a CMADS bus.

FIG. 3 illustrates an exemplified circuit diagram of the CMADS circuit disclosed in Japanese Patent Application Laid-open No. 2001-53598. A CMADS transmitter 81 includes MOS transistors 82 and 83 that alternately turn on depending on a binary input signal DI. A CMADS receiver 86 includes a MOS transistor 87 for supplying a specific current to a transmission line 84*a* when the MOS transistor 82 turns on and a MOS transistor 88 for supplying a specific current to a transmission line 84*b* when the MOS transistor 83 turns on. The CMADS receiver 86 outputs an inverted signal of a drain voltage DR of the MOS transistor 88 as a binary reception output signal DO. In the CMADS circuit, since the CMADS receiver 86 supplies an associated current, a plurality of CMADS receivers 86-1, 86-2, 86-3 can be connected in parallel with respect to one CMADS transmitter 81 via the transmission lines 84*a*, 84*b*, as shown in FIG. 3. Previously making on-resistance of each of the open drain MOS transistors 82 and 83 of the CMADS transmitter 81 sufficiently low requires no optimum design corresponding to the number of the receivers to be connected to the transmitter and thus, allows the CMADS circuit to operate without any problem.

In a case where a LCD device employs the CMADS circuit proposed by the applicant of this invention, the device can reduce its volume in the following manner. That is, the display control circuit 63 has the CMADS transmitter therein at the output portion thereof for outputting a high rate signal such as image data DAT and transmits the image data DAT onto a CMADS bus, and each of the signal line driving ICs 65-1 to 65-m has the CMADS receiver therein at an input portion thereof, thereby reducing the number of wirings used to transmit a high rate signal such as image data DAT. In the CMADS circuit, since data transmission at a rate of about four times that could be achieved by using a conventional CMOS circuit can be made, even taking into account the disadvantageous situation where the CMADS circuit employs a two-wire system, it is possible to reduce the number of bus lines to equal to or smaller than half the number of the conventional bus lines. This configuration of LCD device will be referred to as a second conventional technique, hereinafter. As described above, the applicant of the invention has realized a high-resolution and compact LCD device by applying the CMADS circuit to a LCD device. However, demand for a further miniaturized LCD device is growing and a high-resolution display device is strongly required to further reduce its volume.

SUMMARY OF THE INVENTION

In consideration of the above-described problems found in the conventional technique, the present invention has been conceived and an object of the present invention is to provide a technique for enhancing miniaturization of LCD device to an extent far greater the that has been realized by using the second conventional technique invented by the applicant and further, putting into practical use of further miniaturized liquid crystal display with high resolution.

In order to achieve such an object of the present invention, a semiconductor integrated circuit constructed in accordance with a first aspect of the present invention comprises a plurality of CMADS bus input terminals disposed along a first side of the integrated circuit as one of four sides thereof when viewing the integrated circuit from a position vertical to the integrated circuit, a plurality of CMADS bus output terminals disposed along a second side of the integrated circuit, the CMADS bus output terminals being disposed to individually correspond to the CMADS bus input terminals, the second side being located opposite the first side, internal CMADS bus lines for connecting the CMADS bus input terminals and the CMADS bus output terminals corresponding to the CMADS bus input terminals to each other and a CMADS receiver for receiving a signal of a CMADS amplitude via each of the internal CMADS bus lines and amplifying the signal to provide the amplified signal to a serial-parallel conversion circuit.

The semiconductor integrated circuit of the first aspect of the present invention is used as a signal line driving IC of a LCD device and the LCD device includes m pieces ("m" is a positive integer not less than 2) of signal line driving ICs and a LCD panel such that a first side of each of the m pieces of signal line driving ICs faces a side of the LCD panel in parallel therewith, along which side the input terminals of signal lines of the LCD panel are disposed, and CMADS bus output terminals of the i-th ("i" is a positive integer from 1 to m−1) signal line driving IC are connected to CMADS bus input terminals of the (i+1)-th signal line driving IC, the CMADS bus input terminals of the (i+1)-th signal line driving IC individually corresponding to the CMADS bus output terminals of the i-th signal line driving IC. Disposing and connecting the semiconductor integrated circuit of the present invention as described above allows the CMADS bus to substantially penetrate the inside of the semiconductor integrated circuit, thereby reducing a wiring area required for the second conventional example and further enhancing miniaturization of LCD device.

A semiconductor integrated circuit constructed in accordance with a second aspect of the present invention comprises a plurality of CMADS bus input terminals, a plurality of CMADS bus output terminals disposed to individually correspond to the CMADS bus input terminals, a CMADS receiver for receiving a signal of a CMADS amplitude from each of the CMADS bus input terminals and amplifying the signal to provide the amplified signal to a serial-parallel conversion circuit and a CMADS transmitter for receiving the signal outputted from the CMADS receiver and converting the signal to a signal of a CMADS amplitude, and providing the converted signal to each of the CMADS bus output terminals. The second aspect of the present invention preferably is constructed such that the CMADS bus input terminals are disposed along a first side of the integrated circuit as one of four sides thereof when viewing the integrated circuit from a position vertical to the integrated circuit and the CMADS bus output terminals are disposed along a second side of the integrated circuit, in which the CMADS bus output terminals are disposed to individually correspond to the CMADS bus input terminals and the second side is located opposite the first side.

The semiconductor integrated circuit of the second aspect of the present invention is used as a signal line driving IC of a LCD device and the LCD device includes m pieces ("m" is a positive integer not less than 2) of signal line driving ICs and a LCD panel such that a first side of each of the m pieces of signal line driving ICs faces a side of the LCD panel in parallel therewith, along which side the input terminals of signal lines of the LCD panel are disposed, and CMADS bus output terminals of the i-th ("i" is a positive integer from 1 to m−1) signal line driving IC are connected to CMADS bus input terminals of the (i+1)-th signal line driving IC, the CMADS bus input terminals of the (i+1)-th signal line driving IC individually corresponding to the CMADS bus output terminals of the i-th signal line driving IC. Also in the second aspect of the present invention, since the CMADS bus is disposed to substantially penetrate the inside of the semiconductor integrated circuit, a wiring area required for the second conventional example can be eliminated and miniaturization of LCD device can further be enhanced.

It should be appreciated that the present invention may be constructed such that the signal line driving ICs of the second aspect are interposed every specific pieces of the signal line driving ICs of the first aspect. In this case, the corresponding LCD device includes the aggregate amount of m pieces ("m" is a positive integer not less than 2) of signal line driving ICs and a LCD panel such that a first side of each of the m pieces of signal line driving ICs faces a side of the LCD panel in parallel therewith, along which side the input terminals of signal lines of the LCD panel are disposed, and CMADS bus output terminals of one of the i-th ("i" is a positive integer from 1 to m−1) signal line driving IC of the first aspect or the i-th signal line driving IC of the second aspect are connected to CMADS bus input terminals of one of the (i+1)-th signal line driving IC of the first aspect or the (i+1)-th signal line driving IC of the second aspect, the CMADS bus input terminals of the (i+1)-th signal line driving IC individually corresponding to the CMADS bus output terminals of the i-th signal line driving IC.

A semiconductor integrated circuit constructed in accordance with a third aspect of the present invention comprises a plurality of CMADS bus input terminals, a plurality of CMADS bus output terminals disposed to individually correspond to the CMADS bus input terminals, internal CMADS bus lines, a first CMADS receiver for receiving a signal of a CMADS amplitude from each of the CMADS bus input terminals and amplifying the signal to provide the amplified signal, a first CMADS transmitter disposed adjacent to the first CMADS receiver for receiving the signal outputted from the first CMADS receiver and converting the signal to a signal of a CMADS amplitude, and providing the converted signal to each of the internal CMADS bus lines, a second CMADS receiver for receiving the signal of a CMADS amplitude via each of the internal CMADS bus lines and amplifying the signal to provide the amplified signal, a second CMADS transmitter disposed adjacent to the second CMADS receiver for receiving the signal outputted from the second CMADS receiver and converting the signal to a signal of a CMADS amplitude, and providing the converted signal to each of the CMADS output terminals and a third CMADS receiver for receiving the signal of a CMADS amplitude via each of the internal CMADS bus lines and amplifying the signal to provide the amplified signal to a serial-parallel conversion circuit. The third aspect of the present invention preferably is constructed such that the CMADS bus input terminals are disposed along a first side of the integrated circuit as one of four sides thereof when viewing the integrated circuit from a position vertical to the integrated circuit and the CMADS bus output terminals are disposed along a second side of the integrated circuit, in which the CMADS bus output terminals are disposed to individually correspond to the CMADS bus input terminals and the second side is located opposite the first side.

The semiconductor integrated circuit of the third aspect of the present invention is used as a signal line driving IC of a LCD device and the LCD device includes m pieces ("m" is a positive integer not less than 2) of signal line driving ICs and a LCD panel such that a first side of each of the m pieces of signal line driving ICs faces a side of the LCD panel in parallel therewith, along which side the input terminals of signal lines of the LCD panel are disposed, and CMADS bus output terminals of the i-th ("i" is a positive integer from 1 to m−1) signal line driving IC are connected to CMADS bus input terminals of the (i+1)-th signal line driving IC, the CMADS bus input terminals of the (i+1)-th signal line driving IC individually corresponding to the CMADS bus output terminals of the i-th signal line driving IC. Also in the third aspect of the present invention, since the CMADS bus is disposed to substantially penetrate the inside of the semiconductor integrated circuit, a wiring area required for the second conventional example can be eliminated and miniaturization of LCD device can further be enhanced.

It should be appreciated that the present invention may be constructed such that the signal line driving ICs of the third aspect are interposed every specific pieces of the signal line driving ICs of the first aspect. In this case, the corresponding LCD device includes the aggregate amount of m pieces ("m" is a positive integer not less than 2) of signal line driving ICs and a LCD panel such that a first side of each of the m pieces of signal line driving ICs faces a side of the LCD panel in parallel therewith, along which side the input terminals of signal lines of the LCD panel are disposed, and CMADS bus output terminals of one of the i-th ("i" is a positive integer from 1 to m−1) signal line driving IC of the first aspect or the i-th signal line driving IC of the third aspect are connected to CMADS bus input terminals of one of the (i+1)-th signal line driving IC of the first aspect or the (i+1)-th signal line driving IC of the third aspect, the CMADS bus input terminals of the (i+1)-th signal line driving IC individually corresponding to the CMADS bus output terminals of the i-th signal line driving IC.

A semiconductor integrated circuit constructed in accordance with a fourth aspect of the present invention comprises a plurality of CMADS bus input terminals, a plurality of CMADS bus output terminals disposed to individually correspond to the CMADS bus input terminals, first internal CMADS bus lines, second internal CMADS bus lines, a first CMADS receiver for receiving a signal of a CMADS amplitude from each of the CMADS bus input terminals and amplifying the signal to provide the amplified signal, a first CMADS transmitter disposed adjacent to the first CMADS receiver for receiving the signal outputted from the first CMADS receiver and converting the signal to a signal of a CMADS amplitude, and providing the converted signal to each of the first internal CMADS bus lines, a second CMADS receiver for receiving the signal of a CMADS amplitude via each of the second internal CMADS bus lines and amplifying the signal to provide the amplified signal, a second CMADS transmitter disposed adjacent to the second CMADS receiver for receiving the signal outputted from the second CMADS receiver and converting the signal to a signal of a CMADS amplitude, and providing the converted signal to each of the CMADS output terminals, a third CMADS receiver for receiving the signal of a CMADS amplitude via each of the first internal CMADS bus lines and amplifying the signal to provide the amplified signal to a serial-parallel conversion circuit and a third CMADS transmitter for receiving the amplified signal outputted from the third CMADS receiver and converting the amplified signal to a signal of a CMADS amplitude to provide the converted signal to the second internal CMADS bus lines. The fourth aspect of the present invention preferably is constructed such that the CMADS bus input terminals are disposed along a first side of the integrated circuit as one of four sides thereof when viewing the integrated circuit from a position vertical to the integrated circuit and the CMADS bus output terminals are disposed along a second side of the integrated circuit, in which the CMADS bus output terminals are disposed to individually correspond to the CMADS bus input terminals and the second side is located opposite the first side.

The semiconductor integrated circuit of the fourth aspect of the present invention is used as a signal line driving IC of a LCD device and the LCD device includes m pieces ("m" is a positive integer not less than 2) of signal line driving ICs and a LCD panel such that a first side of each of the m pieces of signal line driving ICs faces a side of the LCD panel in parallel therewith, along which side the input terminals of signal lines of the LCD panel are disposed, and CMADS bus output terminals of the i-th ("i" is a positive integer from 1 to m−1) signal line driving IC are connected to CMADS bus input terminals of the (i+1)-th signal line driving IC, the CMADS bus input terminals of the (i+1)-th signal line driving IC individually corresponding to the CMADS bus output terminals of the i-th signal line driving IC. Also in the fourth aspect of the present invention, since the CMADS bus is disposed to substantially penetrate the inside of the semiconductor integrated circuit, a wiring area required for the second conventional example can be eliminated and miniaturization of LCD device can further be enhanced.

It should be appreciated that the present invention may be constructed such that the signal line driving ICs of the fourth aspect are interposed every specific pieces of the signal line driving ICs of the first aspect. In this case, the corresponding LCD device includes the aggregate amount of m pieces ("m" is a positive integer not less than 2) of signal line driving ICs and a LCD panel such that a first side of each of the m pieces of signal line driving ICs faces a side of the LCD panel in parallel therewith, along which side the input terminals of signal lines of the LCD panel are disposed, and CMADS bus output terminals of one of the i-th ("i" is a positive integer from 1 to m−1) signal line driving IC of the first aspect or the i-th signal line driving IC of the fourth aspect are connected to CMADS bus input terminals of one of the (i+1)-th signal line driving IC of the first aspect or the (i+1)-th signal line driving IC of the fourth aspect, the CMADS bus input terminals of the (i+1)-th signal line driving IC individually corresponding to the CMADS bus output terminals of the i-th signal line driving IC.

The above-described objects and features and other related objects and features of the present invention will be clearly understood referring to the following explanation based on the attached drawings and new matters disclosed in the claims.

DETAILED DESCRIPTION OF THE PREFERRED EMBODIMENTS

Preferred embodiments of the present invention will be explained in detail below with reference to the attached drawings. Note that the following explanation just describes examples of the present invention and therefore, the present invention should not be construed as limited to the embodiments set forth herein.

Figure 1:
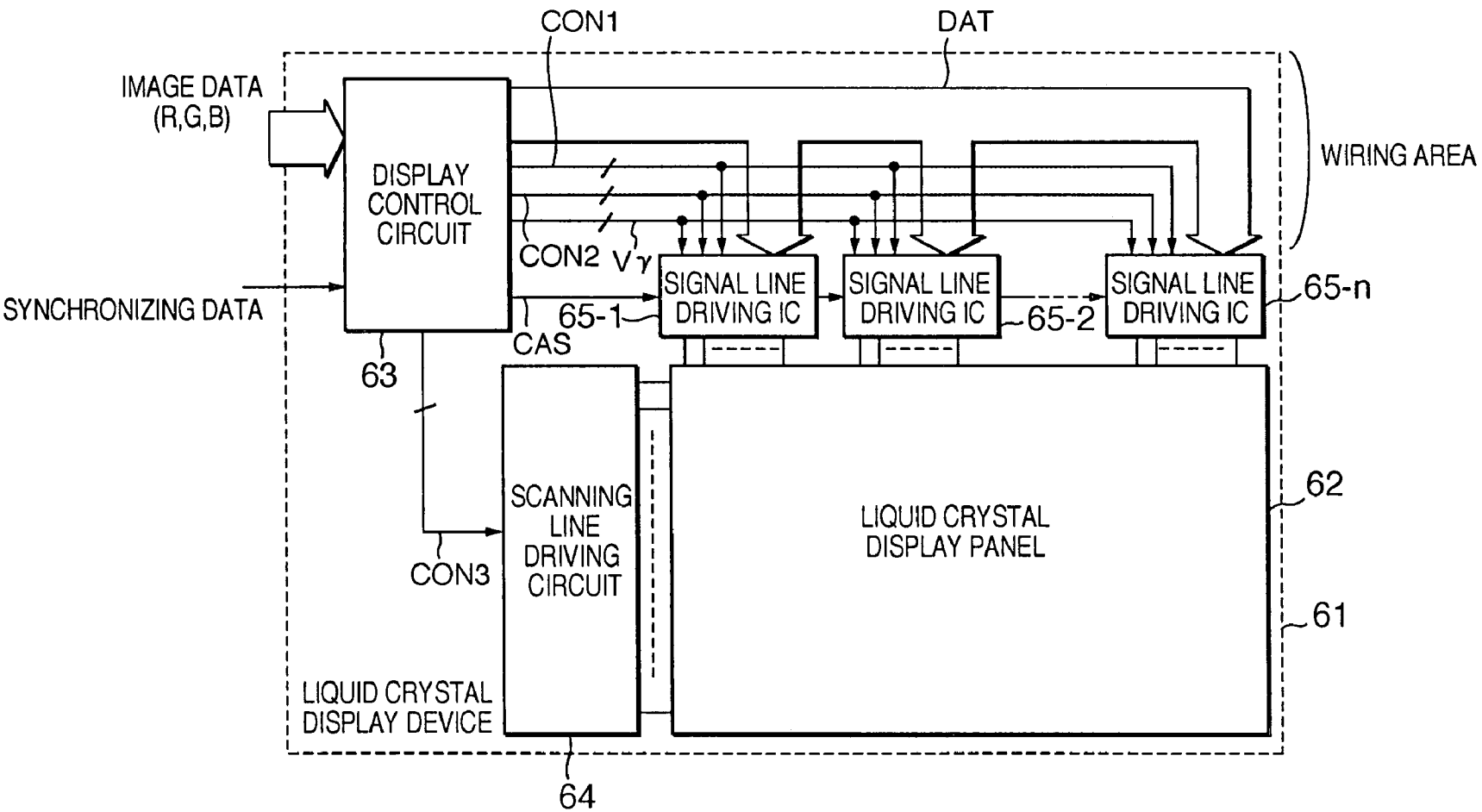
FIG. 1 PRIOR ART
FIG. 1 is a block diagram illustrating the configuration of a conventional LCD device.
Figure 4:
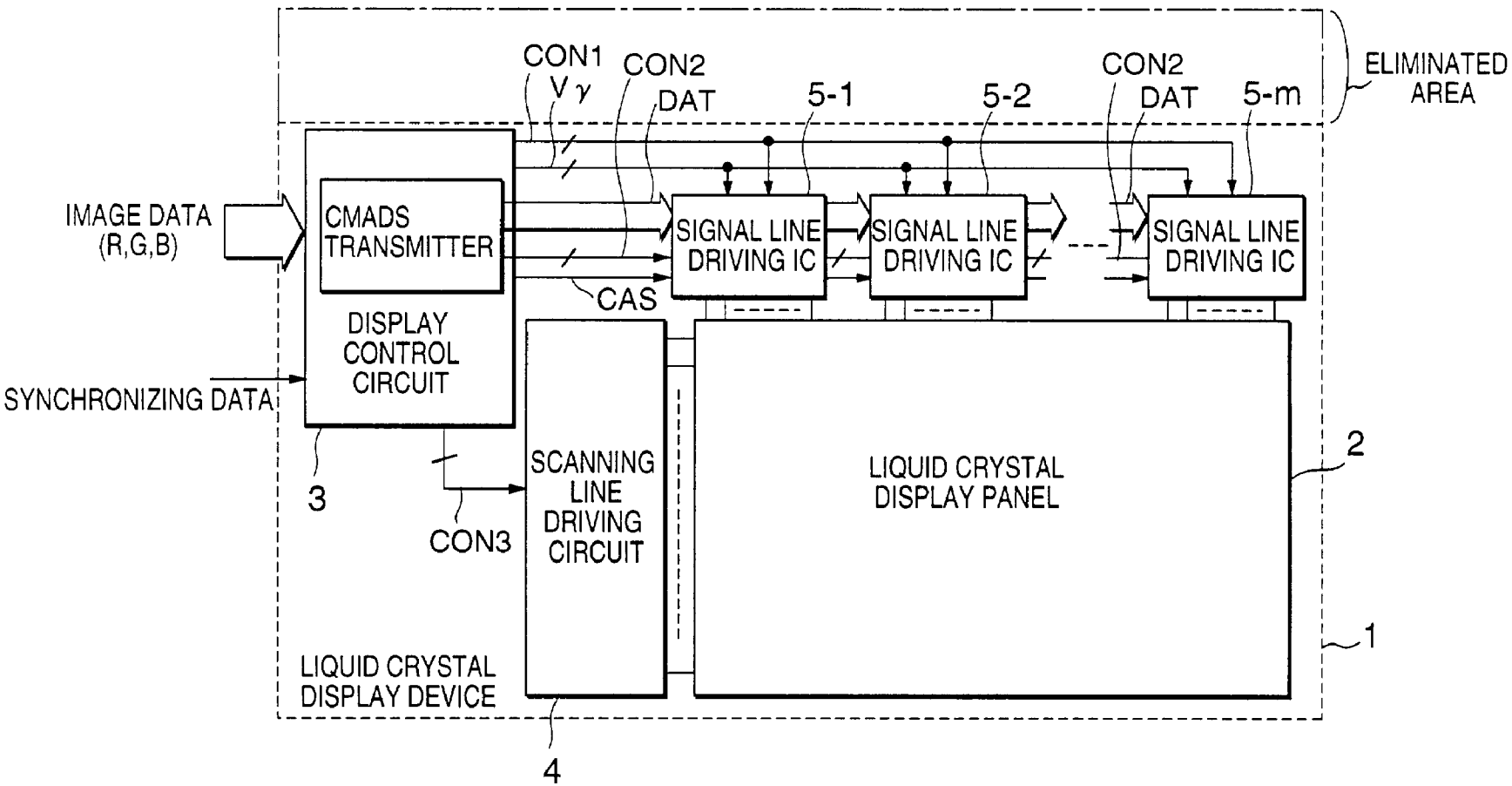
FIG. 4 is a block diagram illustrating the configuration of a LCD device incorporating a semiconductor integrated circuit of the present invention therein.

FIG. 4 is a block diagram illustrating the configuration of a LCD device incorporating a semiconductor integrated circuit constructed in accordance with the present invention therein. Note that a display control circuit 3 functions substantially in the same manner as that observed in the-display control circuit 63 of FIG. 1 and in order to reduce the number of wiring connections necessary for a high rate signal line control signal CON1 and a bus, parallel-serial conversion is made with respect to a signal such as image data DAT to be transmitted and then, the signal is transmitted as a complementary signal of a CMADS amplitude by means of a CMADS transmitter. Although the transmission of the image data DAT and the like by a CMADS method in the present invention is similar to that employed in the second conventional technique, the configuration of a CMADS bus of the present invention is different. That is, since the number of bus lines for transmitting a signal can be reduced to a large extent by applying a CMADS method to transmit the image data, CMADS bus lines of the present invention are made to penetrate signal line driving ICs.

In more detail, in the present invention, each of the signal line driving ICs 5-1 to 5-m is constructed as follows: Input terminals of the signal line driving IC for receiving the image data DAT (and signal line control signal CON2) having a CMADS signal amplitude are disposed along a side (for example, a left side of the IC 5-1) of the IC perpendicular to a side (for example, a lower side of the IC 5-1) thereof along which the signal voltage output terminals of the IC are disposed when viewing the IC from a position vertical thereto; and output terminals of the IC for outputting the image data DAT (and signal line control signal CON2) having a CMADS signal amplitude and disposed to individually correspond to the input terminals for receiving the image data DAT are disposed along a side (a right side of the IC 5-1) thereof opposite the left side. The output terminals of the IC for outputting the image data DAT and the like as a signal of CMADS signal amplitude are disposed in the following manner. That is, the individual input terminals and the output terminals individually corresponding to the input terminals are disposed such that a distance from the input terminal to a side (the lower side of the IC 5-1) of the IC along which the signal voltage output terminals are disposed becomes equal to that from the output terminal corresponding to the input terminal to the side (the lower side of the IC 5-1) of the IC along which the signal voltage output terminals are disposed. This construction of terminals of the IC and CMADS bus realizes substantially the same situation as that described below. That is, a CMADS bus constitutes a straightly continuous line penetrating the inside of the signal line driving ICs, thereby allowing CMADS bus signal lines for transmitting the image data DAT and the like to travel throughout a series of the signal line driving ICs without jackknifing at around the connection portions between adjacent signal line driving ICs. The CMADS bus constructed as described above makes it possible to substantially eliminate an entire part (indicated as the eliminated area in FIG. 4) of an wiring area required for the conventional LCD device, thereby allowing a LCD device employing the present invention to reduce its geometric size to an extent larger than that could be achieved by using the second conventional technique.

Figure 5:
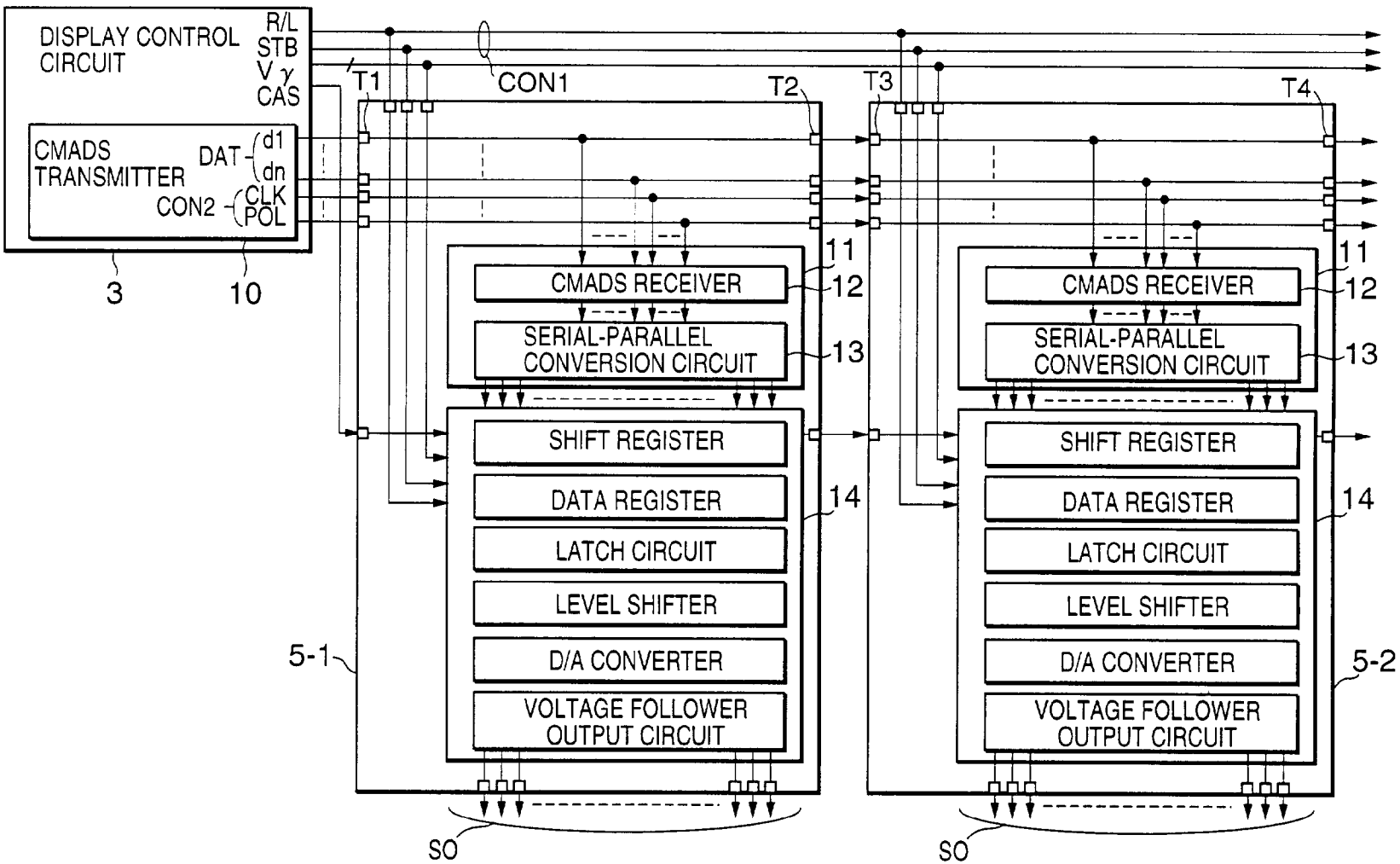
FIG. 5 is a schematic diagram illustrating internal blocks of signal line driving ICs and a state of connection between the display control circuit and the signal line driving ICs adjacent thereto, which are constructed in accordance with the first embodiment of the present invention.

FIG. 5 is a schematic diagram illustrating internal blocks of the signal line driving IC 5, i.e., a semiconductor integrated circuit according to a first embodiment of the present invention and a state of connection between the display control circuit and the signal line driving ICs adjacent thereto. Note that in FIG. 5, a CMADS transmitter 10 within a display control circuit 3 includes a plurality of the CMADS transmitters 81 shown in FIG. 3. The display control circuit 3 transmits a signal line control signal CON2 and image data DAT to the signal line driving IC 5-1 via a CMADS bus connected to the CMADS transmitter 10. In this case, the signal line control signal CON2 is a high rate signal including such as a clock signal CLK and a polarity inversion signal POL, and the image data DAT (including n pieces of data signals d1 to dn) is constructed such that parallel-serial conversion is made in units of a plurality of pixels with respect to image data representing gray scales of each of red, green and blue images to reduce the number of signal lines. Upon reception of the signal from the display control circuit 3, the signal line driving IC 5-1 amplifies the received signal by using a CMADS receiver 12 of a CMADS input circuit 11 such that the amplified signal has an amplitude of a CMOS signal equal to a power supply voltage VDD applied to the internal circuit, and then, supplies the amplified signal to a serial-parallel conversion circuit 13. The serial-parallel conversion circuit 13 restores the image data DAT to the original data format before parallel-serial conversion of image data by the display control circuit 3 and then, supplies the restored data to an internal circuit 14. The internal circuit 14 comprises a sift register, a data register, a latch circuit, a level shifter, a D/A converter and a voltage follower, which configuration is the same as that of the internal circuit of the signal line driving IC 65 of FIG. 2. The internal circuit 14 generates D. C. signal voltage outputs SO by using the image data DAT and reference gray scale voltages Vγ corresponding to the individual colors, i.e., R, G, B, and performing gamma correction according to the V-T characteristics of the LCD panel 2 corresponding to individual colors to thereby obtain specific gamma value of the LCD panel, and then, provides the signal voltage outputs to the associated signal lines of the LCD panel 2. Note that the signal line control signal CON1 actually consists of several signals which change at a relatively low rate such as a sift direction control signal R/L and a latch signal STB, and the signal line control signal CON2 actually consists of several signals which change at a relatively high rate such as by a clock signal CLK and a polarity inversion signal POL, and further, a CAS is a metal line to connect the signal line driving ICs together to make the cascade connection of the signal line driving ICs.

In the embodiment, the signal line driving circuit ICs 5-1, 5-2 each output the signal voltage outputs SO from the terminals thereof disposed along the lower side thereof. In addition, the high rate signal line control signal CON2 (i.e., a clock signal CLK, a polarity inversion signal POL and the like) of a CMADS amplitude and the image data DAT (including n pieces of data signals d1 to dn) of a CMADS amplitude are inputted to the terminals-of the left side of the signal line driving IC 5-1 and the signal line driving IC 5-1 outputs those signals from the terminals of the right side thereof opposite the left side thereof, and then, the signals outputted from the right side thereof are inputted to the terminals of the left side of the signal line driving IC 5-2 disposed next to the signal line driving IC 5-1. In this case, the input terminals of the left side of the signal line driving IC 5-1 for receiving data d1 and the output terminals of the right side thereof for outputting data d1 are disposed such that a distance from the input terminal of the left side for receiving data d1 to the lower side thereof becomes equal to that from the output terminal of the right side for outputting data d1 to the lower side thereof. The input terminals of the left side for receiving data d2 to dn, the clock signal CLK and the polarity inversion signal POL, and the output terminals of the right side for correspondingly outputting those signals also are disposed maintaining the same positional relationship between the input/output terminals and the lower side. Furthermore, since the terminals of the left and right sides of each of the signal line driving ICs 5-1 to 5-m have the same positional relationship as that described in the explanation of the signal line driving IC 5-1, metal lines for transmitting a signal outputted from the right side of the signal line driving IC 5-1 can straightly enter the corresponding terminals of the left side of the signal line driving IC 5-2 disposed next to the IC 5-1 without jackknifing.

Figure 2:
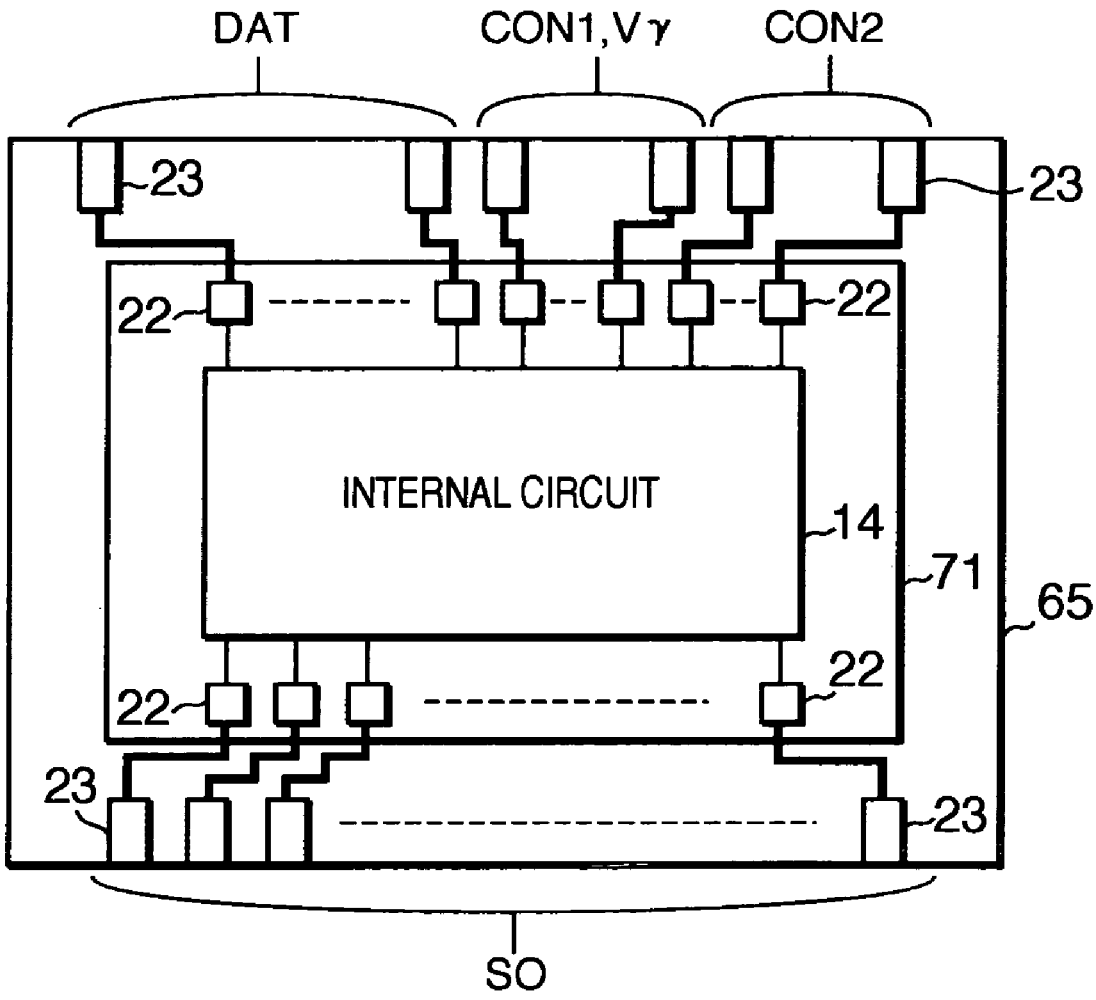
FIG. 2 PRIOR ART
FIG. 2 is a schematic diagram illustrating the internal configuration of a signal line driving IC.
Figure 3:
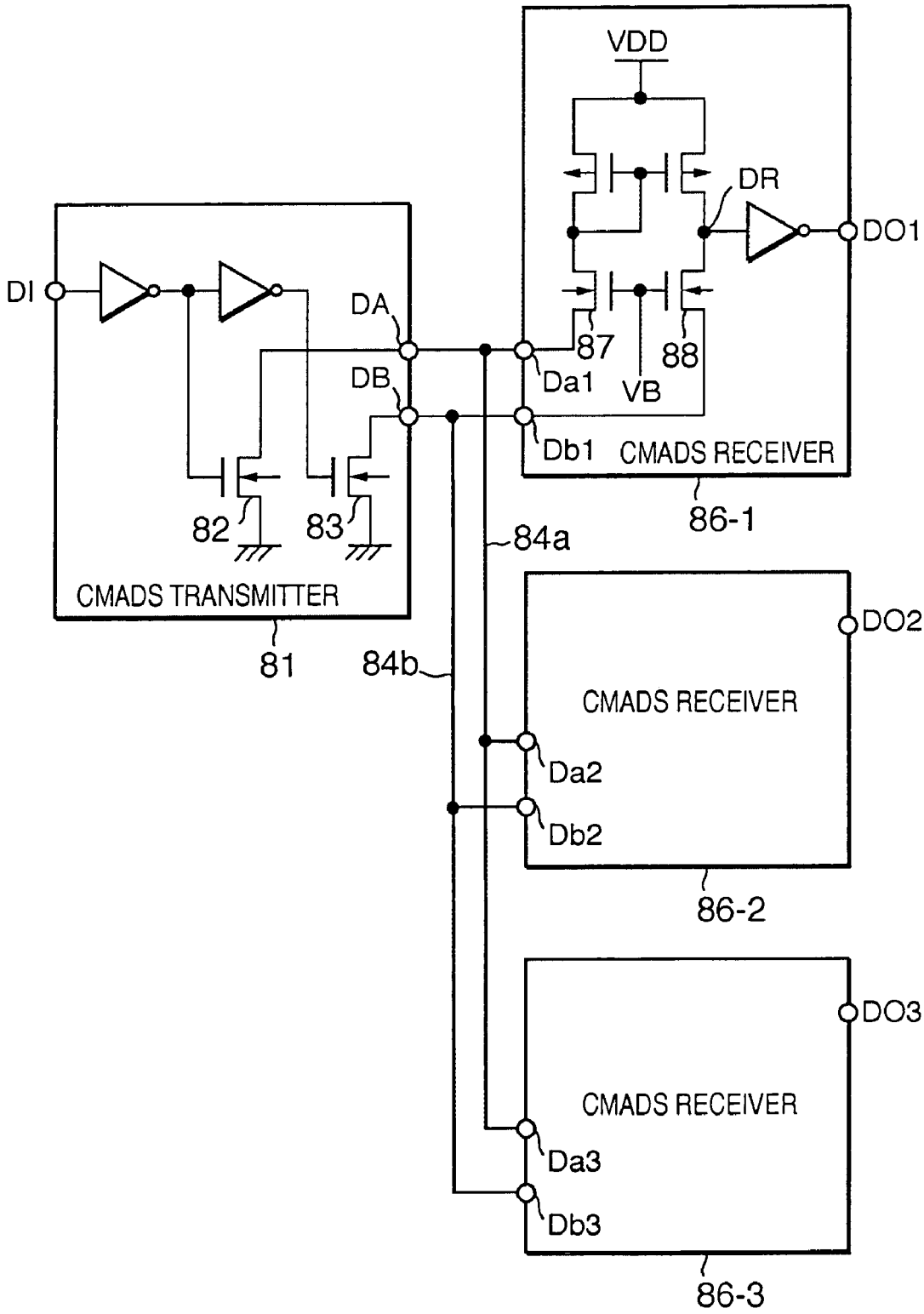
FIG. 3 PRIOR ART
FIG. 3 is a circuit diagram of a CMADS circuit.
Figure 6A:
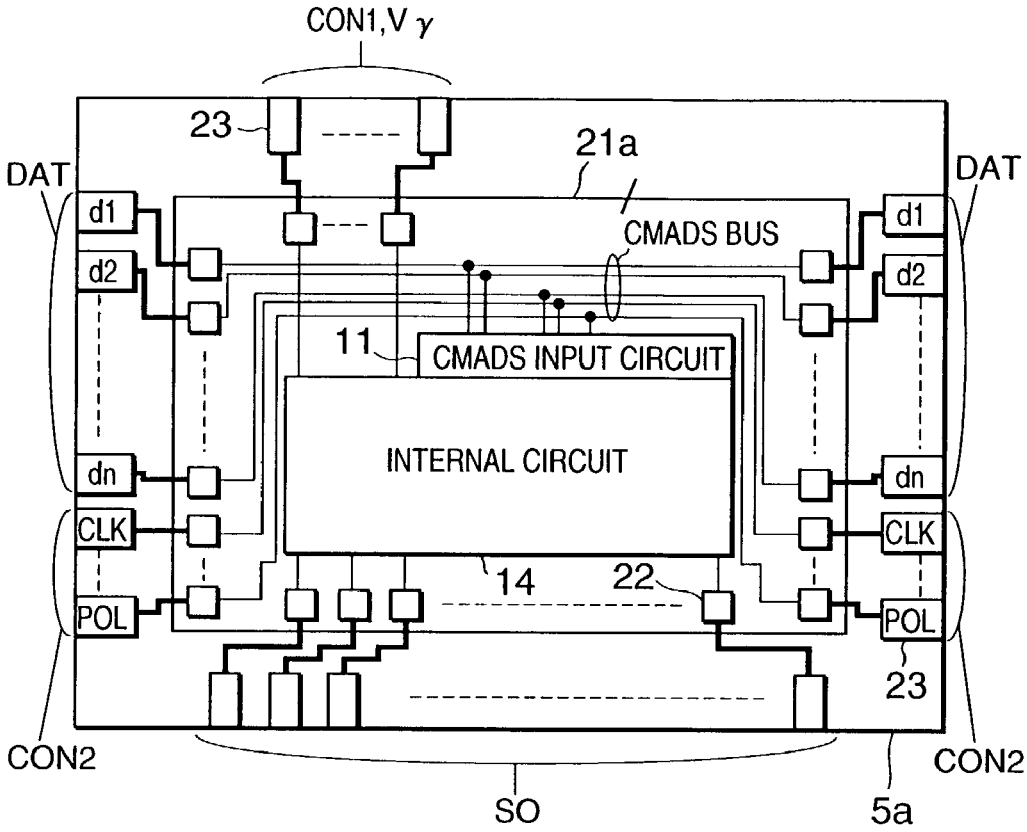
FIG. 6A is a schematic diagram illustrating a layout of the signal line driving IC and an example including the signal line driving IC housed in a package.
Figure 6B:
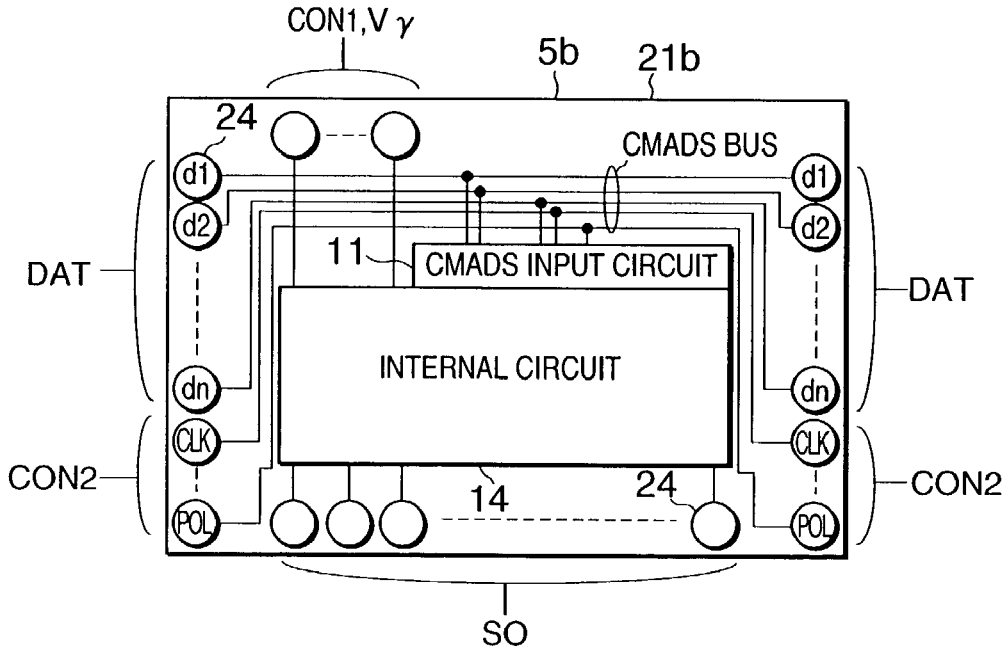
FIG. 6B illustrates an example including the signal line driving IC directly mounted on a substrate of a LCD panel, all of which are constructed in accordance with the first embodiment of the present invention.

FIG. 6 is a schematic diagram illustrating a layout of the signal line driving IC of the first embodiment of the present invention. FIG. 6A illustrates an exemplified signal line driving IC housed in a package such as a TCP, whose construction is the same as that of the conventional example shown in FIG. 2, and FIG. 6B illustrates another exemplified signal line driving IC constructed by directly mounting a chip on a board of a LCD device.

Referring to FIG. 6A, individual pads 22 of a signal line driving IC chip 21*a* are connected to terminals 23, which are external leads of the signal line driving IC 5*a*, and the IC 5*a* outputs signal voltage outputs SO from terminals of the lower side thereof. Furthermore, CMADS bus lines for transmitting image data DAT, etc., travel to individual pads of the left side of the signal line driving IC chip 21*a* after entering through terminals of the left side of the signal line driving IC 5*a*, and then, travel through the chip via internal CMADS bus lines to pads of the right side of the chip, and further, travel to terminals of the right side of the IC 5*a* from the pads of the right side thereof. In this case, a distance from the input terminal of the left side of the signal line driving IC 5*a* for receiving data dj (j denotes a positive integer from 1 to n) to the lower side thereof is equal to that from the output terminal of the right side thereof for outputting the data dj to the lower side thereof. In addition, the input terminals of the left side and the output terminals of the right side corresponding to the input terminals, other than the above-described input and output terminals, also are disposed maintaining the same positional relationship between the input/output terminals for the data dj and the lower side, whose positional relationship has already been explained in the prior description. Note that as shown in FIG. 6A, the internal bus lines are preferably disposed passing within the signal line driving chip 21*a* while detouring around the internal circuit 14 in order for a change of a signal of a large amplitude within the internal circuit not to interfere with the CMADS bus lines for transmitting signals of a minute amplitude. Furthermore, though not shown, generally, at least input pads and output pads of the IC each have protection elements formed for preventing destruction of the IC due to over voltage ESD (Electrostatic Discharge) pulse or the like.

Referring to FIG. 6B, on a pad 24 is formed, for example, a solder bump serving also as a terminal. Accordingly, the individual pads 24 of a signal line driving chip 21*b* serve as terminals of a signal line driving IC 5*b* and the IC 5*b* outputs signal voltage outputs SO from the terminals of the lower side of the IC. In addition, CMADS bus lines for transmitting image data DAT and the like enter through the terminals of the left side of the IC 5*b* and travel through the chip 21*b* to the external output terminals of the right side of the IC via internal CMADS bus lines within the chip 21*b*. In this case, a distance from the input terminal of the left side of the signal line driving IC 5*b* for receiving, for example, data d1 to the lower side thereof is equal to that from the output terminal of the right side thereof for outputting the data d1 to the lower side thereof. In addition, the input terminals of the left side and the output terminals of the right side corresponding to the input terminals, other than the above-described input and output terminals, also are disposed maintaining the same positional relationship between the input/output terminals for data d1 and the lower side. Such positional relationship is the same as that already explained in the description of the signal line driving IC 5*a* shown in FIG. 6A. Furthermore, the internal bus lines preferably are disposed passing within the signal line driving chip 21*b* while detouring around the internal circuit 14, whose construction also is the same as that explained in the description of the signal line driving IC 5*a* shown in FIG. 6A. Moreover, normally, input pads and output pads of the IC 5*b* each have protection elements for preventing destruction of the IC due to over voltage ESD pulse or the like, whose construction also is the same as that explained in the description of the signal line driving IC 5*a* shown in FIG. 6A.

In general, a semiconductor integrated circuit chip is mounted on a printed circuit board and wiring pitch on the printed circuit board is far wider than, i.e., 10 to 100 times, that within the semiconductor integrated circuit chip. In the embodiments shown in FIGS. 6A, 6B, to make the wiring pitch within the signal line driving IC and the wiring pitch on the board of the LCD device coincide with each other at a geometric interface between the IC and the board, almost all space for input wiring from the printed circuit board is allocated to the interface through which incoming bus lines from the outside enter one of short sides of the signal line driving IC. In addition, within the signal line driving IC, CMADS bus lines consisting of small pitch metal lines are disposed passing through narrow space for wiring to the other side of two short sides of the IC. Furthermore, almost all space for output wiring to the printed circuit board is allocated to the interface through which outgoing bus lines from the other of short sides of the IC exit to the outside.

Figure 7:
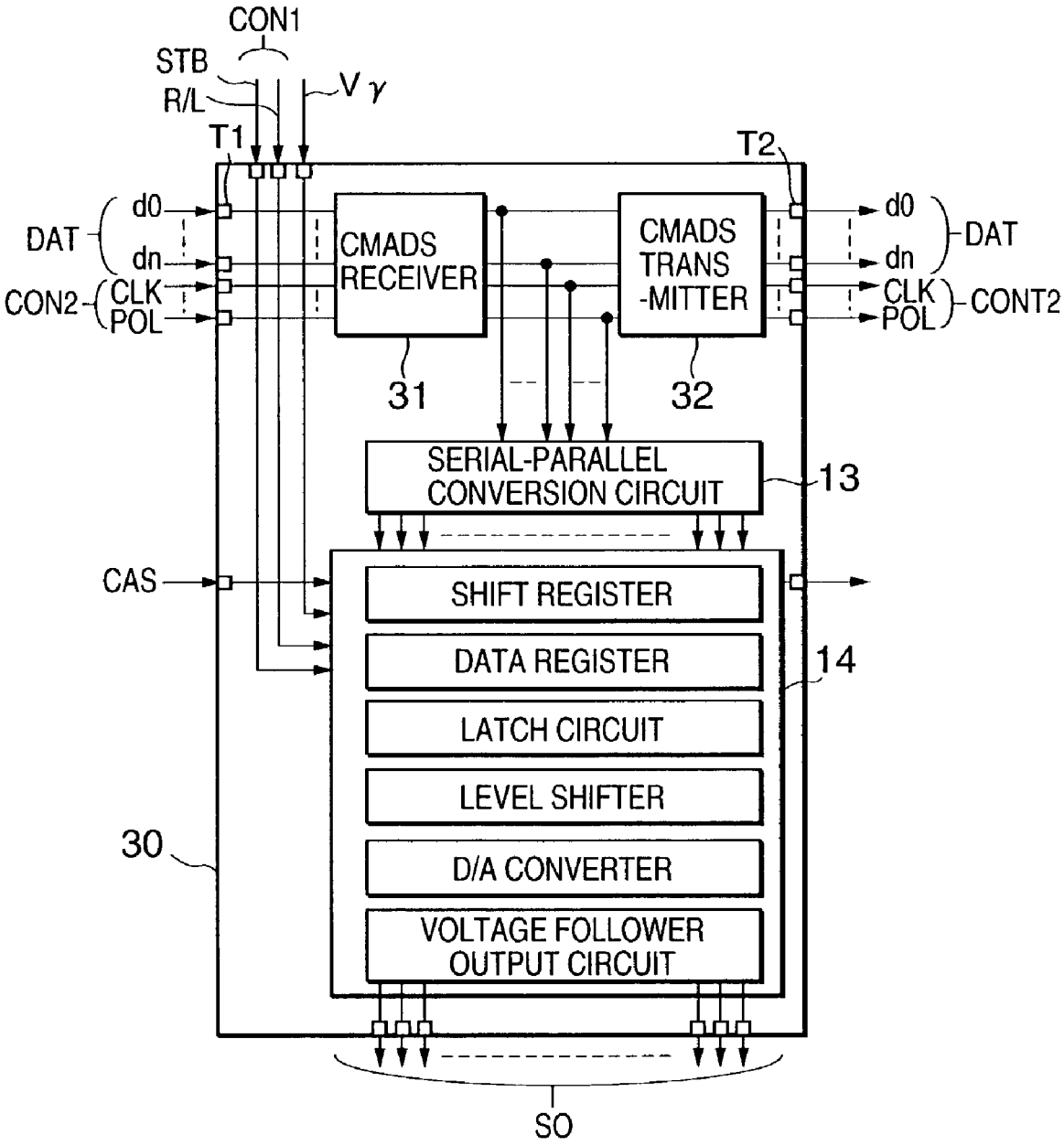
FIG. 7 is a schematic diagram illustrating internal blocks of signal line driving ICs constructed in accordance with the second embodiment of the present invention.

A second embodiment of the present invention will be explained below. FIG. 7 is a schematic diagram illustrating internal blocks of a signal line driving IC of the second embodiment of the present invention. In a signal line driving IC 30 of FIG. 7, the input terminals of the left side of the IC for receiving data dj (j denotes a positive integer from 1 to n) and the corresponding output terminals of the right side thereof for outputting data dj are disposed such that a distance from the input terminal of the left side thereof for receiving data dj to the lower side thereof is equal to that from the output terminal of the right side thereof for outputting the data dj to the lower side thereof, whose construction is the same as that explained in the description of the signal line driving IC 5 shown in FIG. 5. Difference between the first and second embodiments is as follows. That is, whereas the first embodiment is constructed such that the CMADS input circuit has the CMADS receiver 12 and the serial-parallel conversion circuit 13 therein, the second embodiment has a CMADS transmitter 32 therein in addition to a CMADS receiver 31 and a serial-parallel conversion circuit 13. In the embodiment, the CMADS receiver 31 amplifies image data DAT and the like received via a CMADS bus to produce a signal having an amplitude of a CMOS signal equal to a power supply voltage VDD, and then, supplies the amplified signal to a serial-parallel conversion circuit 13. At the same time, the CMADS transmitter 32 again converts the signal such as image data DAT once converted to have an amplitude of a CMOS signal equal to a power supply voltage VDD to a signal of a CMADS signal amplitude and then, transmits the converted signal to the next stage signal line driving IC.

Referring to a diagram illustrating a disposition/connection layout of signal line driving ICs of FIG. 8A, an interface configuration of, the second embodiment will be explained. Image data DAT and a signal line control signal CON2 are transmitted from a CMADS transmitter 10 of a display control circuit 3 to a CMADS receiver 31 within a signal line driving IC 30-1 via a CMADS bus and amplified to have an amplitude of a CMOS signal equal to a power supply voltage VDD. When the signal received by the signal line driving IC 30-1 is a signal necessary for an internal circuit 14 of the IC 30-1, the signal is inputted to a serial-parallel conversion circuit 13. On the other hand, when the signal is a signal unnecessary for an internal circuit 14, the signal is again converted back to a signal of a CMADS signal amplitude by the CMADS transmitter 32 within the signal line driving IC 30-1 and then, the signal thus converted is transmitted as image data to a signal line driving IC 30-2 disposed next to the signal line driving IC 30-1. Signal line driving ICs 30-2 to 30-6 following the signal line driving IC 30-1 are disposed having the same interface configurations as that of the IC 30-1 and data transmission is performed in the same manner as that explained in the description of the IC 30-1 including the interface configuration associated therewith.

Figure 8A:
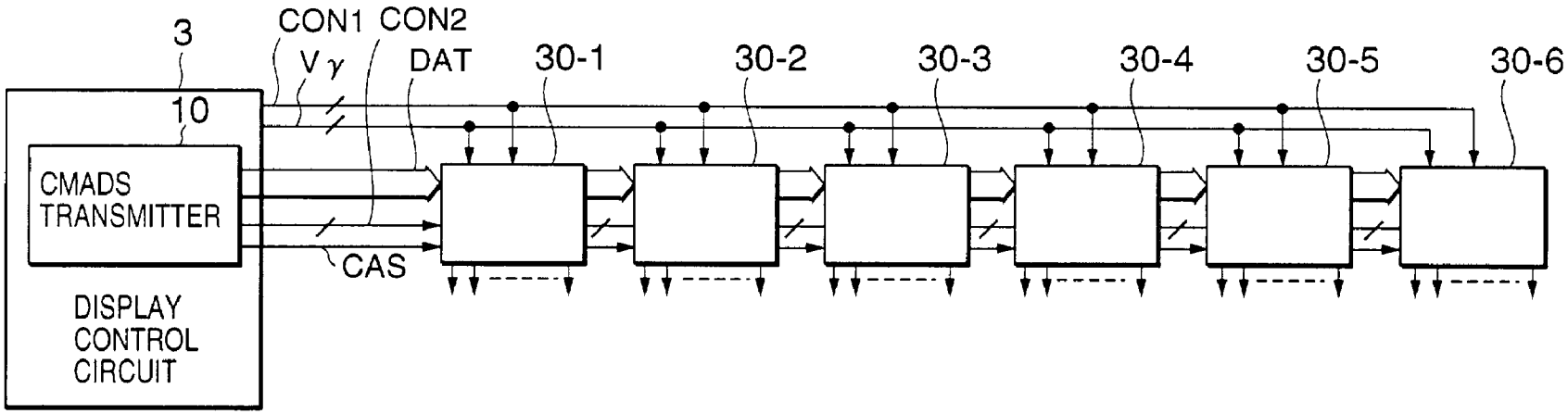
FIG. 8A illustrates a disposition/connection layout in which only the signal line driving ICs of the second embodiment are coupled in series and FIG. 8B illustrates a disposition/connection layout in which the signal line driving ICs of the second embodiment are partially interposed between the signal line driving ICs, coupled in series, of the first embodiment.
Figure 8B:
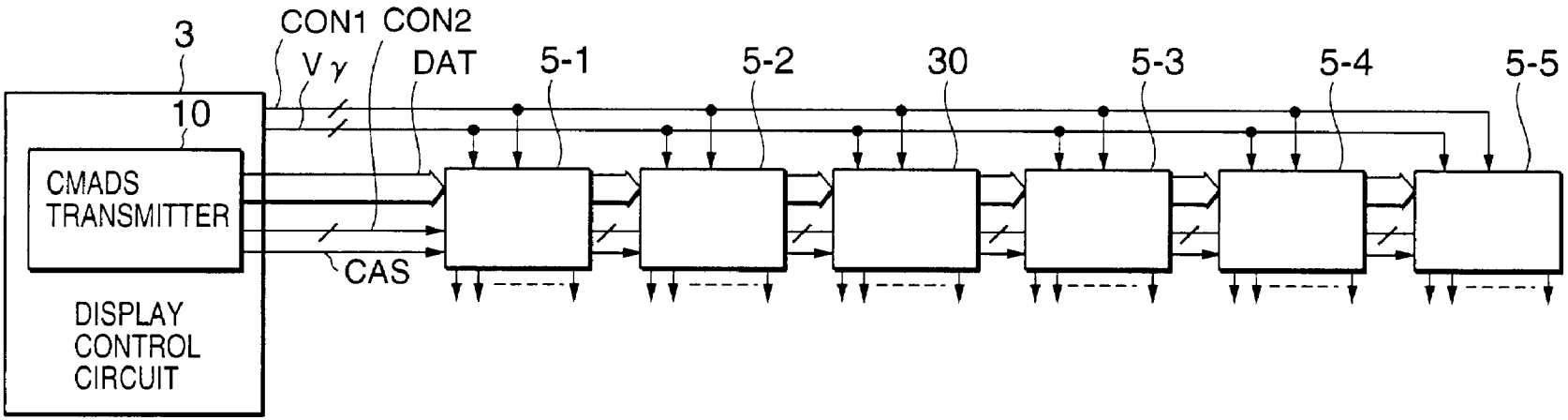

In a case where the signal line driving ICs 5 of the first embodiment are employed instead of the signal line driving ICs 30 and the interfaces are constructed by coupling only the ICs 5 in series as shown in FIG. 8A, in proportion to the number of the signal line driving ICs 5 coupled in series, the ICs 5 are in danger of not operating normally owing to the influence of the capacitive load on the wiring within each of the ICs 5. Contrary to it, in a case where the signal line driving ICs 30 of the second embodiment are coupled in series as shown in FIG. 8A and a signal is transmitted from one IC 30 to another IC 30 following the one IC 30 after correction of the level of a signal to be transmitted via the CMADS bus, data can stably be transmitted with high reliability. It should be noted that although the signal line driving ICs can be used in the second embodiment such that only the signal line driving ICs 30 of the second embodiment are coupled in series as shown in FIG. 8A, the signal line driving ICs 30 of the second embodiment may be interposed every specific pieces of the signal line driving ICs 5 of the first embodiment, as shown in FIG. 8B. Disposing and coupling the signal line driving ICs 5 and 30 as shown in FIG. 8B makes it possible to make the number of CMADS receivers equal to or less than a specific number with respect to one CMADS transmitter and further, enhance reliability of transmission of data since correction of the level of a signal to be transmitted via the CMADS bus is performed in specific ICs where the CMADS bus enters after traveling through predetermined pieces of the signal line driving ICs. In addition, the number of CMADS transmitters can be reduced compared to the case where only the signal line driving ICs 30 of the second embodiment are coupled in series as shown in FIG. 8A and therefore, power consumption associated with the signal line driving ICs also can be reduced.

It should be noted that also in the embodiment, the signal line driving IC may be constructed by housing a signal line driving chip in a package, whose construction is explained in conjunction with FIG. 6A, or may be constructed by directly mounting a signal line driving chip on a board of a LCD device, whose construction is explained in conjunction with FIG. 6B.

Figure 9:
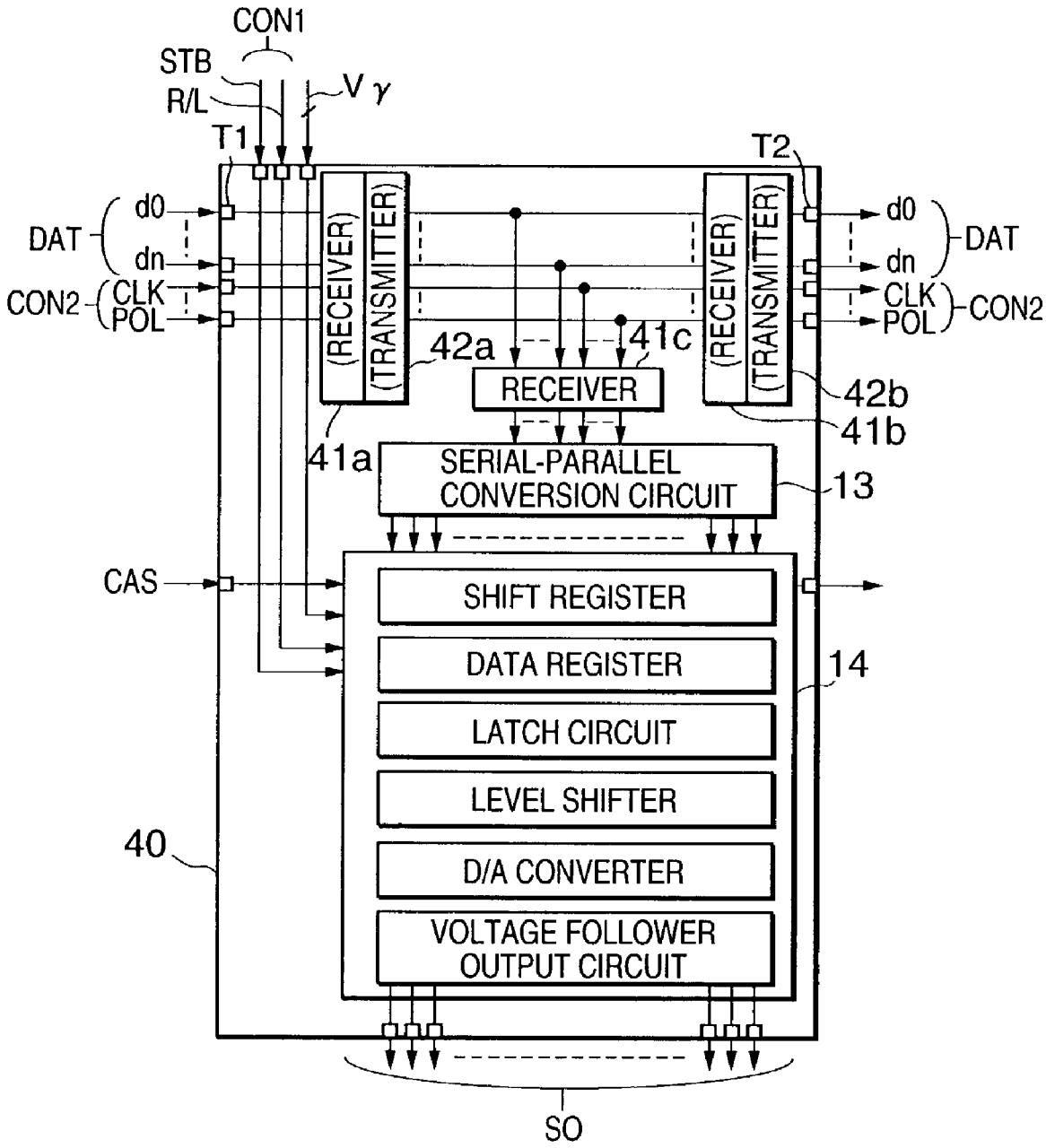
FIG. 9 is a schematic diagram illustrating internal blocks of signal line driving ICs constructed in accordance with the third embodiment of the present invention.

A third embodiment of the present invention will be explained below. FIG. 9 is a schematic diagram illustrating internal blocks of a signal line driving IC of the third embodiment of the present invention. In a signal line driving IC 40, the input terminals of the left side of the IC for receiving data dj (j denotes a positive integer from 1 to n) and the corresponding output terminals of the right side thereof for outputting data dj are disposed such that a distance from the input terminal of the left side thereof for receiving data dj to the lower side thereof is equal to that from the output terminal of the right side thereof for outputting the data dj to the lower side thereof, whose construction is the same as those explained in the description of the signal line driving IC 5 of the first embodiment and the signal line driving IC 30 of the second embodiment. Difference between the first and third embodiments is as follows. That is, the third embodiment is constructed such that a pair of a first CMADS receiver 41*a* and a first CMADS transmitter 42*a* are disposed at the entrance through which a CMADS bus disposed penetrating each of the signal line driving ICs enters an associated IC and a pair of a second CMADS receiver 41*b* and a second CMADS transmitter 42*b* are disposed at the exit through which the CMADS bus exits from the associated IC.

An interface configuration of the third embodiment, will be explained. Image data DAT and a signal line control signal CON2 are transmitted to a signal line driving IC 40 via the CMADS bus and received by the first CMADS receiver 41*a*. The received data is again converted by the first CMADS transmitter 42*a* to a signal of a CMADS amplitude and then, transmitted via an internal CMADS bus within the signal line driving IC 40. When the data transmitted from the first CMADS transmitter 42*a* is data necessary for an internal circuit 14 of the signal line driving IC 40, the data is inputted to a third CMADS receiver 41*c*. On the other hand, when the data is data unnecessary for the internal circuit 14, the data is transmitted to the second CMADS receiver 41*b* located at the exit of the signal line driving IC 40. Subsequent to conversion of data by the first CMADS transmitter 42*a*, the data received by the second CMADS receiver 41*b* is converted again by the second CMADS transmitter 42*b* to a signal of a CMADS amplitude and then, the data thus converted is transmitted to the next stage signal line driving IC 40 (not shown).

Also in the embodiment, the same construction of signal line driving IC as that explained in the description of the signal line driving IC 30 of the second embodiment can be employed. That is, in a case where the signal line driving ICs 5 of the first embodiment are employed as a signal line driving IC and the CMADS bus is connected entirely to the individual CMADS receivers each contained in each of a number of the signal line driving ICs, and therefore, the ICs are in danger of not operating normally owing to the influence of the capacitive load on the wiring within each of the ICs, the signal line driving ICs 40 are employed as a signal line driving IC instead of the signal line driving ICs 5 of the first embodiment, thereby enabling to stably transmit data with high reliability. In the embodiment, since the signal having a CMADS amplitude and inputted from outside is once amplified and again converted immediately after amplification of the signal, and then, transmitted via the internal CMADS bus, the signal thus transmitted becomes more stable against the influence of the capacitive load on the wiring within the signal line driving IC compare to the signal transmitted within the signal line driving IC 30 of the second embodiment. Furthermore, it should be noted that although the signal line driving IC can be used in the third embodiment such that only the signal line driving ICs 40 are coupled in series as shown in FIG. 8A, the signal line driving ICs 40 may be interposed every specific pieces of the signal line driving ICs 5 of the first embodiment, as shown in FIG. 8B. Disposing and coupling the signal line driving ICs 5 and 40 as shown in FIG. 8B makes it possible to strengthen the level of a signal transmitted via the CMADS bus to enhance reliability of a signal to be transmitted and further, make the number of CMADS transmitters and receivers reduced, thereby reducing power consumption associated with the signal line driving ICs.

It should be noted that also in the embodiment, the signal line driving IC may be constructed by housing a signal line driving chip in a package, whose construction is explained in conjunction with FIG. 6A, or may be constructed by directly mounting a signal line driving chip itself on a board of a LCD device, whose construction is explained in conjunction with FIG. 6B.

Figure 10:
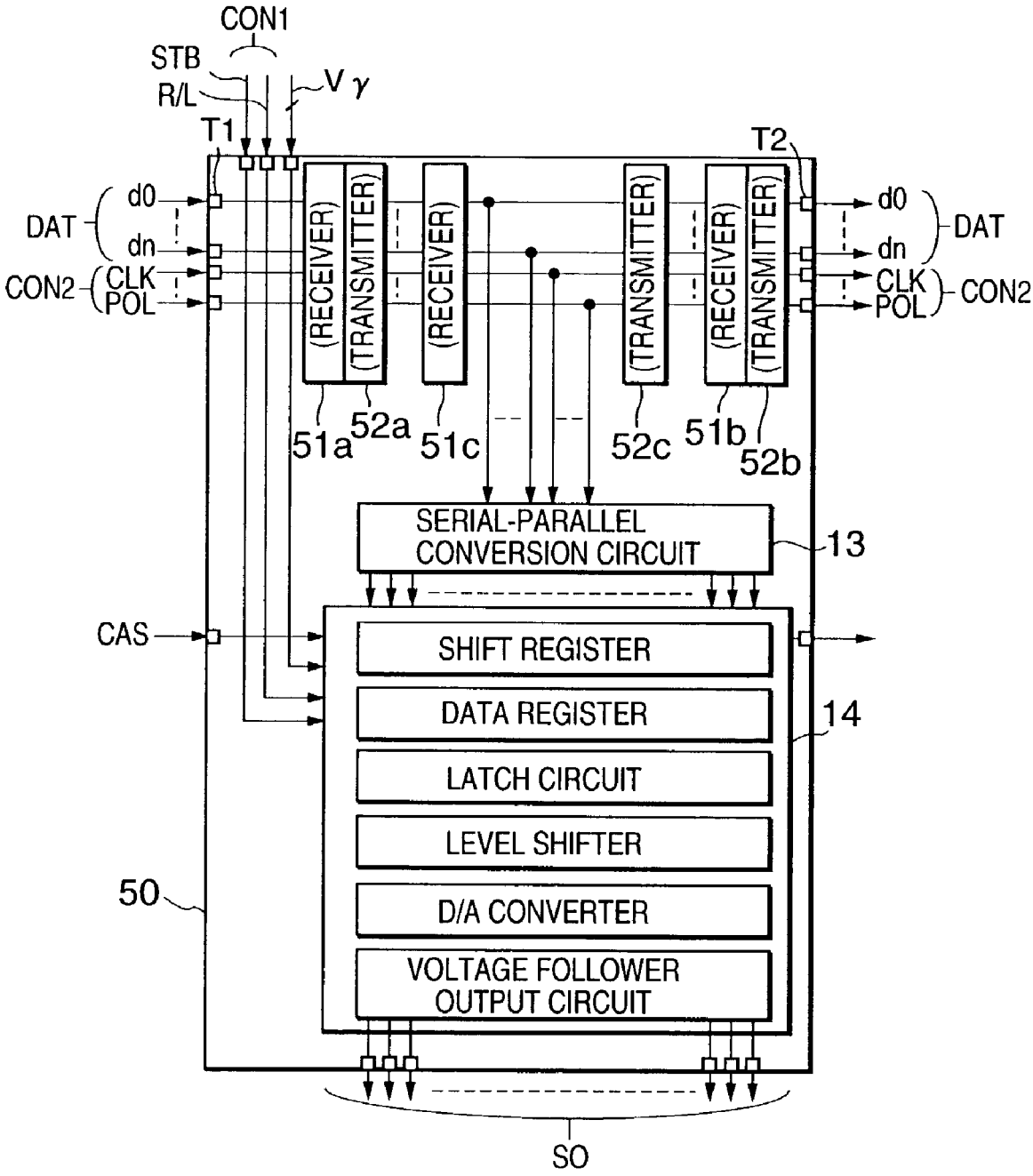
FIG. 10 is a schematic diagram illustrating internal blocks of signal line driving ICs constructed in accordance with the fourth embodiment of the present invention.

A fourth embodiment of the present invention will be explained below. FIG. 10 is a schematic diagram illustrating internal blocks of a signal line driving IC of the fourth embodiment of the present invention. In a signal line driving IC 50, the input terminals of the left side of the IC for receiving data dj (j denotes a positive integer from 1 to n) and the corresponding output terminals of the right side thereof for outputting data dj are disposed such that a distance from the input terminal of the left side thereof for receiving data dj to the lower side thereof is equal to that from the output terminal of the right side thereof for outputting the data dj to the lower side thereof, whose construction is the same as those explained in the description of the signal line driving IC 5 of the first embodiment, the signal line driving IC 30 of the second embodiment and the signal line driving IC 40 of the third embodiment. Note that the signal line driving IC 50 is constructed by combining the configurations of the signal line driving IC 30 of the second embodiment and the signal line driving IC 40 of the third embodiment. That is, the signal line driving IC 50 is constructed such that a pair of a first CMADS receiver 51*a* and a first CMADS transmitter 52*a* are disposed at the entrance at the entrance through which a CMADS bus disposed penetrating each of the signal line driving ICs enters an associated IC and a pair of a second CMADS receiver 51*b* and a second CMADS transmitter 52*b* are disposed at the exit through which the CMADS bus exits from the associated IC, whose construction is explained in the description of the signal line driving IC 40. In addition to it, a third CMADS receiver 51*c* for receiving a signal via a first internal CMADS bus and a third transmitter 52*c* for transmitting a signal via a second internal CMADS bus are provided in the fourth embodiment, whose construction is explained in the description of the signal line driving IC 30. In this case, the third CMADS receiver 51*c* amplifies the signal having a CMADS amplitude and transmitted from the first CMADS transmitter 52*a* via the first internal CMADS bus to produce a signal having an amplitude of a CMOS signal and supplies the amplified signal to a serial-parallel conversion circuit 13. In addition, the third CMADS transmitter 52*c* again converts the signal having an amplitude of a CMOS signal to the signal of a CMADS amplitude and supplies the converted signal to the second CMADS receiver 51*b* via the second internal CMADS bus.

In a case where the signal line driving ICs 5 of the first embodiment are employed as a signal line driving IC and the CMADS bus is connected entirely to the individual CMADS receivers each contained in each of a number of the signal line driving ICs, and therefore, the ICs are in danger of not operating normally owing to the influence of the capacitive load on the wiring within each of the ICs, employing the signal line driving ICs 50 of the embodiment as a signal line driving IC instead of the signal line driving ICs 5 of the first embodiment enables to stably transmit data with high reliability and enhance stability of data to be transmitted against the influence of the capacitive load on the wiring within the signal line driving IC, the latter of those phenomena being also observed in the third embodiment and further enhanced compared to the second embodiment. Furthermore, it should be noted that although the signal line driving ICs can be used in the fourth embodiment such that only the signal line driving ICs 50 are coupled in series as shown in FIG. 8A, the signal line driving ICs 50 may be interposed every specific pieces of the signal line driving ICs 5 of the first embodiment, as shown in FIG. 8B. Disposing and coupling the signal line driving ICs 5 and 50 as shown in FIG. 8B makes it possible to correct the level of a signal transmitted via the CMADS bus and further, make the number of CMADS transmitters and receivers reduced, thereby reducing power consumption associated with the signal line driving ICs.

It should be noted that also in the embodiment, the signal line driving IC may be constructed by housing a signal line driving chip in a package, whose construction is explained in conjunction with FIG. 6A, or may be constructed by directly mounting a signal line driving chip itself on a board of a LCD device, whose construction is explained in conjunction with FIG. 6B.

Although the embodiments described so far each have been described as an example in which a technique for reducing a wiring area on a printed circuit board by making a CMADS bus penetrate signal line driving ICs is applied to a LCD device, the present invention is not limited to those embodiments and therefore, the technique constructed in accordance with the present invention can be applied to, for example, a compact and high rate microcomputer that can be realized such that a microcomputer incorporating a MPU chip, a memory chip, a peripheral chip, etc., therein performs parallel-serial conversion with respect to data to be transmitted while making the data become a signal of a CMADS amplitude and disposes a CMADS bus to straightly penetrate the above-described chips to thereby couple those chips together.

As described so far, the present invention is constructed such that a CMADS bus is employed to reduce the number of bus lines for transmitting a signal such as image data and configured to be able to enter a side of the IC perpendicular to the side along which external terminals of the IC for outputting a signal voltage output are disposed. In addition to the above-described construction, CMADS external input terminals of the IC and CMADS external output terminals thereof corresponding to the external input terminals are disposed such that a distance from the external input terminal to the lower side thereof along which the external output terminals for signal voltage outputs are disposed becomes equal to that from the external output terminal thereof to the lower side thereof, thereby allowing the CMADS bus lines to substantially penetrate the signal line driving ICs. This construction of CMADS bus and signal line driving ICs makes it possible to house bus lines whose wiring pitch becomes wide on a printed circuit board within an integrated circuit chip, in which wiring pitch is narrow, thereby enabling miniaturization of printed circuit board and allowing a LCD device to further reduce its volume to an extent larger than that could be achieved by employing the second conventional example.

What is claimed is:

1. An integrated circuit comprising:

first, second, third and fourth sides a plurality of input terminals disposed along the first side of said integrated circuit;

a plurality of output terminals disposed along the second side of said integrated circuit, said second side being located opposite said first side;

a plurality of internal data bus lines each for connecting a corresponding one of said input terminals and corresponding one of said output terminals;

a receiver connected to said internal data bus lines for receiving signals each having a first amplitude and amplifying said signals to output signals having a second amplitude which is larger than said first amplitude; and a serial-parallel conversion circuit to receive said amplified signals to output parallel data signals.

2. The integrated circuit according to claim 1, wherein said signals are image data and further including an internal circuit for processing said image data to produce a signal voltage output and to provide said signal voltage output to a liquid crystal display panel.

3. The integrated circuit according to claim 1, wherein a reference side of said integrated circuit is determined such that one of two sides thereof perpendicular to an input side thereof having said input terminals disposed along said input side, and said input terminals and said output terminals are disposed such that a distance from each of said input terminals to said reference side and a distance from each of said output terminals corresponding to said input terminals to said reference side are equal to each other.

4. The integrated circuit according to claim 2, wherein said internal data bus lines are disposed detouring around said internal circuit.

5. The integrated circuit according to claim 3, wherein said input terminals and said output terminals are leads of a package.

6. The integrated circuit according to claim 3, wherein said input terminals and said output terminals are pads formed on a chip.

7. An integrated circuit comprising:

a plurality of data input terminals;

a plurality of data output terminals disposed to individually correspond to said input terminals;

a receiver for receiving a signal of a first amplitude from each of said data input terminals and amplifying said signals to provide said amplified signals at a second amplitude to a serial-parallel conversion circuit; and a transmitter for receiving said signals outputted from said receiver and converting said signals to converted signals each at a third amplitude, and providing said converted signals to a respective one of said data output terminals.

8. An integrated circuit comprising:

first, second, third and fourth sides a plurality of input terminals disposed along the first side of said integrated circuit;

a plurality of output terminals disposed along the second side of said integrated circuit, said second side being located opposite said first side;

a first plurality of internal data bus lines each individually connected to a respective one of said input terminals;

a second plurality of internal data bus lines each individually connected to a respective one of said output terminals;

a receiver connected to said first plurality of internal data bus lines for receiving signals each of a first amplitude and amplifying said signals to output signals having a second amplitude which is larger than said first amplitude;

a serial-parallel conversion circuit to receive said amplified signals to output parallel data signals; and a transmitter for receiving said signals outputted from said receiver and converting said signals to converted signals of a third amplitude, and providing said converted signals to each of said second internal data bus lines respectively.

9. The integrated circuit according to claim 8, wherein said signals are image data and further including an internal circuit for processing said image data to produce a signal voltage output and to provide said signal voltage output to a liquid crystal display panel.

10. The integrated circuit according to claim 8, wherein a reference side of said integrated circuit is determined such that one of two sides thereof perpendicular to an input side thereof having said input terminals disposed along said input side, and said input terminals and said output terminals are disposed such that a distance from each of said input terminals to said reference side and a distance from each of said output terminals corresponding to said input terminals to said reference side are equal to each other.

11. The integrated circuit according to claim 9, wherein said first plurality of internal data bus lines and said second plurality of internal data bus lines are disposed detouring around said internal circuit.

12. The integrated circuit according to claim 10, wherein said input terminals and said output terminals are leads of a package.

13. The integrated circuit according to claim 10, wherein said input terminals and said output terminals are pads formed on a chip.

14. An integrated circuit comprising:

a plurality of input terminals;

a plurality of output terminals disposed to individually correspond to said input terminals;

internal data bus lines;

a first receiver for receiving a plurality of signals each of a first amplitude from each of said input terminals and amplifying said signals to output amplified signals each of a second amplitude which is larger than said first amplitude;

a first transmitter disposed adjacent to said first receiver for receiving said signals outputted from said first receiver and for converting said signals to first converted signals of a third amplitude, and providing said first converted signal to each of said internal data bus lines respectively;

a second receiver for receiving said signals of said third amplitude via respective ones of said internal data bus lines and amplifying said signals to provide amplified signals each at a fourth amplitude;

a second transmitter disposed adjacent to said second receiver for receiving said signals outputted from said second receiver and for converting said signals to second converted signals of a fifth amplitude, and providing said second converted signals to each of said output terminals respectively; and a third receiver connected to said internal data bus lines for receiving signals of a sixth amplitude and amplifying said signals to output amplified signals having a seventh amplitude to a serial-parallel conversion circuit.

15. An integrated circuit comprising:

first, second, third and fourth sides a plurality of bus input terminals disposed along the first side of said integrated circuit;

a plurality of output terminals disposed along the second side of said integrated circuit, said second side being located opposite said first side;

a plurality of internal data bus lines;

a first receiver connected to said plurality of internal data bus lines for receiving signals each having a first amplitude and amplifying said signals to output amplified signals having a second amplitude larger than said first amplitude;

a first transmitter disposed adjacent to said first receiver for receiving said signals outputted from said first receiver and converting said signals to signals of a third amplitude, and providing said converted signals to each of said internal data bus lines respectively;

a second receiver for receiving said signals of said third amplitude via respective ones of said internal data bus lines and for amplifying said signals to provide amplified signals each at a fourth amplitude;

a second transmitter disposed adjacent to said second receiver for receiving said signals outputted from said second receiver and converting said signals to signals of a fifth amplitude, and providing said converted signal to each of said output terminals respectively; and a third receiver connected to said internal data bus lines for receiving signals of a sixth amplitude and amplifying said signals to output amplified signals having a seventh amplitude to a serial-parallel conversion circuit.

16. The integrated circuit according to claim 15, wherein said signals are image data and further including an internal circuit for processing said image data to produce a signal voltage output and to provide said signal voltage output to a liquid crystal display panel.

17. The integrated circuit according to claim 15, wherein a reference side of said integrated circuit is determined such that one of two sides thereof perpendicular to an input side thereof having said input terminals disposed along said input side, and said input terminals and said output terminals are disposed such that a distance from each of said input terminals to said reference side and a distance from each of said output terminals corresponding to said input terminals to said reference side are equal to each other.

18. The integrated circuit according to claim 16, wherein said internal data bus lines are disposed detouring around said internal circuit.

19. The integrated circuit according to claim 17, wherein said input terminals and said output terminals are leads of a package.

20. The integrated circuit according to claim 17, wherein said input terminals and said output terminals are pads formed on a chip.

21. An integrated circuit comprising:

a plurality of input terminals;

a plurality of output terminals disposed to individually correspond to said plurality of input terminals;

first internal data bus lines;

second internal data bus lines;

a first receiver for receiving a signal of a first amplitude from each of said input terminals and amplifying said signals to output amplified signals having a second amplitude larger than said first amplitude;

a first transmitter disposed adjacent to said first receiver for receiving said signals outputted from said first receiver and converting said signals to first converted signals of a third amplitude, and providing said first converted signals to each of said first internal data bus lines respectively;

a second receiver for receiving said signals of said third amplitude via respective ones of second internal data bus lines and amplifying said signals to provide said amplified signals having a fourth amplitude;

a second transmitter disposed adjacent to said second receiver for receiving said signals outputted from said second receiver and for converting said signals to second converted signals of a fifth amplitude, and providing said second converted signals to each of said output terminals respectively;

a third receiver connected to said first internal data bus for receiving signals of a sixth amplitude and amplifying said signals to output said amplified signals to a serial-parallel conversion circuit; and a third transmitter for receiving said amplified signals outputted from said third receiver and for converting said amplified signals to a third converted signal of a seventh amplitude and to provide said third converted signals to said second internal data bus lines respectively.

22. An integrated circuit comprising:

first, second, third, and fourth sides a plurality of input terminals disposed along the first side of said integrated circuit;

a plurality of output terminals disposed along the second side of said integrated circuit, said second side being located opposite said first side;

first internal data bus lines;

second internal data bus lines;

a first receiver connected to said input terminals for receiving a plurality of signals of a first amplitude and for amplifying said signals to output amplified signals having a second amplitude larger than said first amplitude;

a first transmitter disposed adjacent to said first receiver for receiving said signals outputted from said first receiver and for converting said signals to first converted signals of a third amplitude, and providing said first converted signals to each of said first internal data bus lines respectively;

a second receiver for receiving said signals of said third amplitude via respective ones of said second internal data bus lines and amplifying said signals to provide amplified signals each at a fourth amplitude;

a second transmitter disposed adjacent to said second receiver for receiving said signals outputted from said second receiver and for converting said signals to second converted signals of a fifth amplitude, and providing said second converted signal to each of said output terminals respectively;

a third receiver connected to said first internal data bus lines for receiving said signals of a sixth amplitude and amplifying said signals to output amplified signals having a seventh amplitude to a serial-parallel conversion circuit; and a third transmitter for receiving said amplified signals outputted from said third receiver and for converting said amplified signals to a third converted signal of an eighth amplitude to provide said third converted signal to each of said second internal data bus lines respectively.

23. The integrated circuit according to claim 22, wherein said signals are image data and further comprising an internal circuit for processing said image data to produce a signal voltage output and to provide said signal voltage output to a liquid crystal display panel.

24. The integrated circuit according to claim 22, wherein a reference side of said integrated circuit is determined such that one of two sides thereof perpendicular to an input side thereof having said input terminals disposed along said input side, and said input terminals and said output terminals are disposed such that a distance from each of said input terminals to said reference side and a distance from each of said output terminals corresponding to said input terminals to said reference side are equal to each other.

25. The integrated circuit according to claim 23, wherein said first internal data bus lines and said second internal data bus lines are disposed detouring around said internal circuit.

26. The integrated circuit according to claim 24, wherein said input terminals and said output terminals are leads of a package.

27. The integrated circuit according to claim 24, wherein said input terminals and said output terminals are pads formed on a chip.

* * * * *